US008027492B2

(12) United States Patent
Miller

(10) Patent No.: US 8,027,492 B2
(45) Date of Patent: Sep. 27, 2011

(54) ARMATURE FOR A RECEIVER

(75) Inventor: Thomas Edward Miller, Arlington Heights, IL (US)

(73) Assignee: Knowles Electronics, LLC, Itasca, IL (US)

( * ) Notice: Subject to any disclaimer, the term of this patent is extended or adjusted under 35 U.S.C. 154(b) by 330 days.

(21) Appl. No.: 12/237,731

(22) Filed: Sep. 25, 2008

(65) Prior Publication Data

US 2009/0016561 A1 Jan. 15, 2009

Related U.S. Application Data

(60) Division of application No. 10/769,528, filed on Jan. 30, 2004, now Pat. No. 7,443,997, which is a continuation of application No. 09/850,776, filed on May 8, 2001, now abandoned.

(60) Provisional application No. 60/202,957, filed on May 9, 2000, provisional application No. 60/218,996, filed on Jul. 17, 2000.

(51) Int. Cl.
*H04R 25/00* (2006.01)
*H04R 9/08* (2006.01)

(52) U.S. Cl. ..... 381/177; 381/369

(58) Field of Classification Search ..... 381/355, 381/369, 417, 418

See application file for complete search history.

(56) References Cited

U.S. PATENT DOCUMENTS 1,799,510 A 4/1931 Goldberg et al.
3,002,058 A 9/1961 Knowles
3,515,818 A 6/1970 Tibbetts
3,588,383 A 6/1971 Carlson et al.
3,617,653 A 11/1971 Tibbetts et al.
3,935,398 A 1/1976 Carlson et al.
4,002,863 A 1/1977 Broersma
4,015,227 A 3/1977 Riko et al.
4,109,116 A 8/1978 Victoreen (Continued)

FOREIGN PATENT DOCUMENTS

GB 2 229 339 A 9/1990

(Continued)

OTHER PUBLICATIONS

International Search Report for Application No. PCT/US05/000875 dated May 20, 2005.

*Primary Examiner* — Brian Ensey

(74) *Attorney, Agent, or Firm* — Fitch, Even, Tabin & Flannery

(57) ABSTRACT

An armature for a receiver comprising a first and a second leg portion each having a thickness and a width and connected to each other, and a connection portion in communication with the first and second leg portions. The connection portion has a width greater than the width of the first and second leg portions individually. The connection portion reduces the stiffness of the armature and minimizes magnetic reluctance of the connection between the first and second leg portions. According to one aspect of the invention, the first and second leg portions are integrally formed with the connection portion and the connection portion includes a least a portion having a thickness less than the thickness of the first and second leg portions individually to reduce the stiffness of the armature. According to another aspect of the invention, the first and second leg portions are separately formed and attached to the connection portion in a way that reduces the stiffness of the armature.

14 Claims, 3 Drawing Sheets

U.S. PATENT DOCUMENTS

| | | | | |
|---|---|---|---|---|
| 4,272,654 | A | 6/1981 | Carlson | |
| 4,410,769 | A | 10/1983 | Tibbetts | |
| 4,473,722 | A | 9/1984 | Wilton | |
| 4,628,907 | A | 12/1986 | Epley | |
| 4,956,868 | A | 9/1990 | Carlson | |
| 5,068,901 | A | 11/1991 | Carlson | |
| 5,193,116 | A | 3/1993 | Mostardo | |
| 5,647,013 | A | 7/1997 | Salvage et al. | |
| 5,757,947 | A | 5/1998 | Van Halteren et al. | |
| 5,809,158 | A | 9/1998 | Van Halteren et al. | |
| 5,960,093 | A | 9/1999 | Miller | |
| 6,041,131 | A | 3/2000 | Kirchhoefer et al. | |
| 6,075,870 | A | 6/2000 | Geschiere et al. | |
| 6,078,677 | A | 6/2000 | Dolleman et al. | |
| 6,658,134 | B1 | 12/2003 | Van Hal et al. | |
| 6,757,403 | B2 * | 6/2004 | Urushibata et al. | 381/418 |
| 2001/0022844 | A1 | 9/2001 | Urushibata et al. | |
| 2002/0003890 | A1 | 1/2002 | Warren et al. | |

FOREIGN PATENT DOCUMENTS

| | | | |
|---|---|---|---|
| WO | 01/87008 | A3 | 11/2001 |

* cited by examiner

FIG. 6
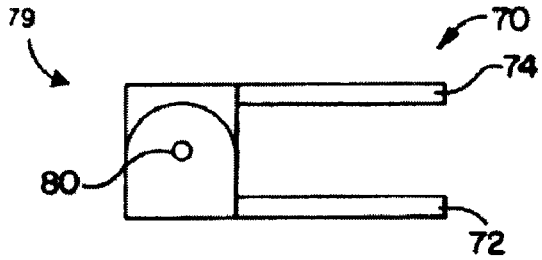
FIG. 7
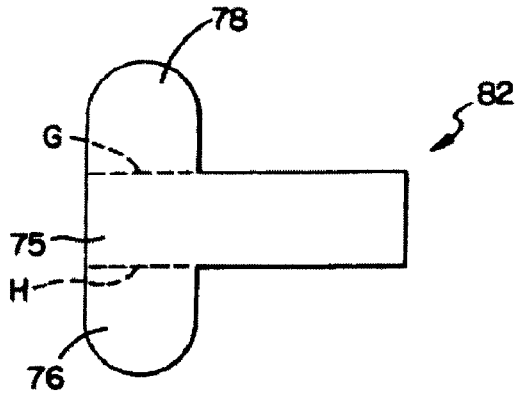
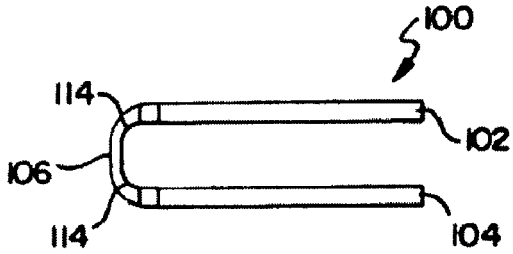
FIG. 8
FIG. 9
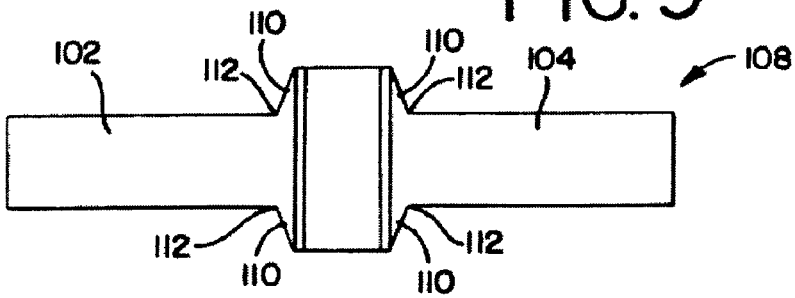
FIG. 10
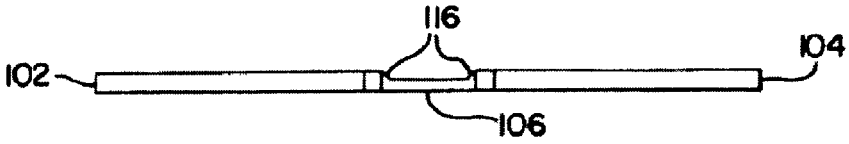

ARMATURE FOR A RECEIVER

RELATED APPLICATIONS

This application is a divisional of U.S. application Ser. No. 10/769,528, entitled "Armature for a Receiver," filed Jan. 30, 2004, which is a continuation of U.S. application Ser. No. 09/850,776, filed May 8, 2001, which claims the benefit of U.S. Provisional Application No. 60/202,957, filed May 9, 2000, and U.S. Provisional Application No. 60/218,996, filed Jul. 17, 2000.

TECHNICAL FIELD

The present invention generally relates to receivers for microelectronic devices, and more particularly to armatures for use in hearing aid receiver transducers.

BACKGROUND OF THE INVENTION

Electroacoustic transducers are capable of converting electric energy to acoustic energy and vice versa. Electroacoustic receivers typically convert electric energy to acoustic energy through a motor assembly having a movable armature. Typically, the armature has one end that is free to move while the other end is fixed to a housing of the receiver. The assembly also includes a drive coil and one or more magnets, both capable of magnetically interacting with the armature. The armature is typically connected to a diaphragm near its movable end. When the drive coil is excited by an electrical signal, it magnetizes the armature. Interaction of the magnetized armature and the magnetic fields of the magnets causes the movable end of the armature to vibrate. Movement of the diaphragm connected to the armature produces sound for output to the human ear. Examples of such transducers are disclosed in U.S. Pat. Nos. 3,588,383, 4,272,654 and 5,193,116.

The sound pressure output of a receiver is created by the travel, or deflection, of the armature when it vibrates. Maximum deflection of the moving armature creates maximum sound pressure output for a given armature geometry. The maximum deflection of an armature is limited by the magnetic saturation of the armature, which is governed by the maximum magnetic flux that the armature geometry can allow to pass therethrough. Therefore, the magnetic flux must be increased in order to increase the sound pressure output. The magnetic flux is limited by material type and cross-sectional area of the armature. Although an increase in the cross-sectional area causes a proportional increase in the maximum magnetic flux, the relative stiffness of the armature increases as well. Thus, merely increasing the cross-sectional area of the armature geometry does not provide a significant improvement in the maximum deflection of the armature.

The present invention addresses these and other problems.

SUMMARY OF THE INVENTION

An armature for a receiver comprising a first and a second leg portion each having a thickness and a width and connected to each other, and a connection portion in communication with the first and second leg portions. The connection portion has a width greater than the width of the first and second leg portions individually. The connection portion reduces the stiffness of the armature and minimizes magnetic reluctance of the connection between the first and second leg portions. According to one aspect of the invention, the first and second leg portions are integrally formed with the connection portion and the connection portion includes at least a portion having a thickness less than the thickness of the first and second leg portions individually to reduce the stiffness of the armature. According to another aspect of the invention, the first and second leg portions are separately formed and attached to the connection portion in a way that reduces the stiffness of the armature.

BRIEF DESCRIPTION OF THE DRAWINGS

FIG. 6 is an elevational side view of a third embodiment of a two-piece armature assembly of the invention.

FIG. 7 is a top plan view of a first preform used to form a first leg of the armature assembly as shown in FIG. 6.

FIG. 8 is an elevational side view of a one-piece armature according to the invention.

FIG. 9 is a top plan view of a blank used to form the one-piece armature shown in FIG. 8.

FIG. 10 is an elevational side view of the blank shown in FIG. 9.

DETAILED DESCRIPTION OF THE PREFERRED EMBODIMENTS

While the invention will be described fully hereinafter with reference to the accompanying drawings, in which particular embodiments are shown, it is to be understood at the outset that persons skilled in the art may modify the invention herein described while still achieving the desired result of this invention. Accordingly, the description which follows is to be understood as a broad informative disclosure directed to persons skilled in the appropriate arts and not as limitations of the invention.

Figure 1:
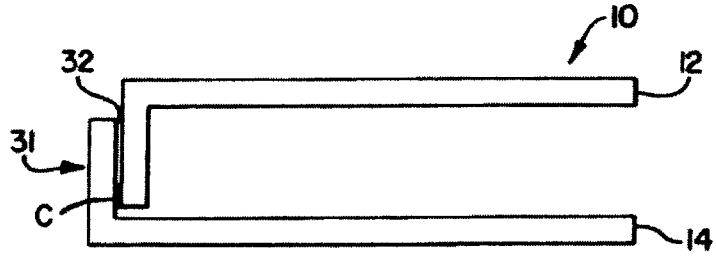
FIG. 1 is an elevational side view of a first embodiment of a two-piece armature assembly according to the invention.
Figure 2:
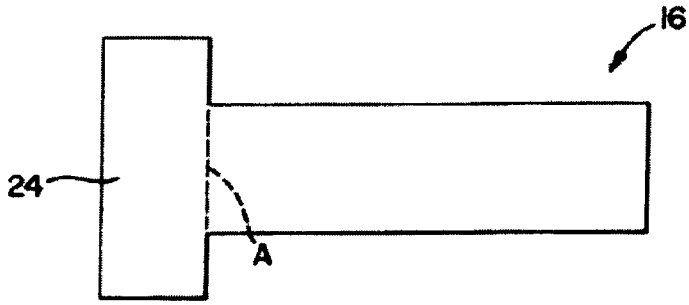
FIG. 2 is a top plan view of a first preform used to form a first leg of the armature assembly shown in FIG. 1.
Figure 3:
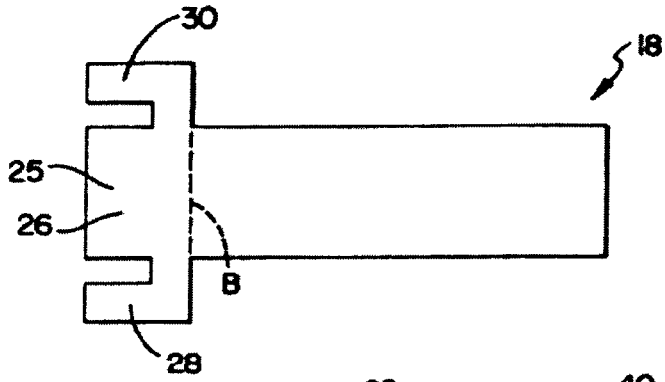
FIG. 3 is a top plan view of a second preform used to form a second leg of the armature assembly as shown in FIG. 1.

FIG. 1 illustrates a first embodiment of a two-piece armature assembly 10. The armature assembly 10 comprises a first leg portion 12 and a second leg portion 14. FIG. 2 shows a preform 16 used to form the first leg portion 12. FIG. 3 shows a second preform 18 used to form the second leg portion 14. The leg portions 12 and 14 are formed by bending the preforms 16 and 18 along bend lines A and B, respectively. The bend lines A and B are merely reference lines for purposes of illustrating the line along which the preforms 16 and 18 are bent and are not formed on the preforms 16 and 18. However, in an alternate embodiment, the preforms 16 and 18 may be provided with a score line or other means (not shown) to aid in the bending of the preforms 16 and 18.

The first leg portion 12 includes a connection region or segment 24, as shown in FIG. 2. The second leg portion 14 includes a connection region or segment 25, as shown in FIG.

3. The connection segment 25 includes a magnetic keeper region 26 and integrally formed connecting straps 28 and 30 disposed adjacent to the magnetic keeper region 26, as shown in FIG. 3. The connecting straps 28 and 30 provide a surface for the second leg portion 14 to be attached to the first leg portion 12, as shown in FIG. 1. Alternatively, the connecting straps 28 and 30 can be integrally formed with the first leg portion 12. Furthermore, the connecting straps 28 and 30 may be fabricated as separate pieces and mechanically connected to either or both of the leg portions 12 and 14. In a preferred embodiment, the first and second leg portions 12 and 14 are welded together.

When the first and second leg portions 12 and 14 are assembled, a connection portion 31 is formed, as shown in FIG. 1. Within the connection portion 31, the connection segment 24 of the first leg portion 12 and the magnetic keeper region 26 of the connection segment 25 of the second leg portion 14 overlap and define a gap 32 therebetween, as shown in FIG. 1. The gap 32 provides clearance between the two leg portions 12 and 14 to allow adequate deflection of one of the leg portions 12 and 14 with respect to the other. Preferably, the first leg portion 12 is fixed relative to the second leg portion 14. Preferably, the leg portions 12 and 14 are fixed by a weld C disposed between the connecting straps 28 and 30 of the connection segment 25 and the connection segment 24, as shown in FIG. 1. Preferably, the weld C between the connecting straps 28 and 30 of the connection segment 25 of the second leg portion 14 and the connection segment 24 of the first leg portion 12 is a contact weld. However, any type of weld well known in the metal fabrication arts can be used. To insure that the gap 32 is formed between the connection segment 24 and the magnetic keeper region 26 of the connection segment 25, either segment 24, region 26 or the connecting straps 28 and 30 may be punched or swaged to form a bump or other raised portion (not shown) that acts as a standoff between the segment 24 and the region 26 of the segment 25.

The overlapping connection segment 24 and the magnetic keeper region 26 of the connection segment 25 have large enough surface area to minimize the magnetic reluctance between the two leg portions 12 and 14. This allows maximum magnetic flux to pass through the armature assembly 10. The gap 32 can be sized to accommodate the maximum deflection of one of the leg portions 12 and 14 for a maximum flux defined by the armature assembly 10.

Figure 4:
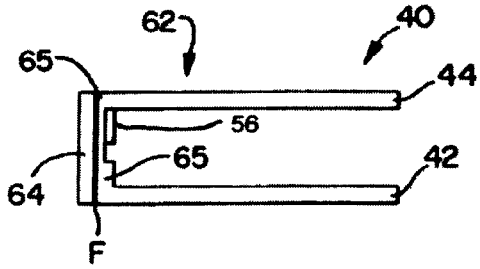
FIG. 4 is a side elevational view of a second embodiment of a two-piece armature assembly of the invention.
Figure 5:
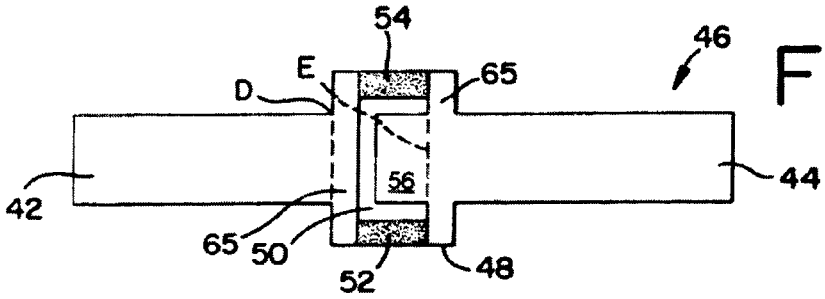
FIG. 5 is a top plan view of a preform used to form a leg portion of the armature assembly shown in FIG. 4.

FIG. 4 illustrates an alternate embodiment armature assembly 40. In this embodiment, a first leg portion 42 and a second leg portion 44 are integrally formed from a single preform 46, as shown in FIG. 5. The preform 46 includes a central connection portion 48 having a cutout 50 defining connection legs 52 and 54 and a magnetic keeper region 56. The connection legs 52 and 54 are etched or machined to be thinner than the thickness of the remaining portions of the perform 46. This reduces the stiffness of the connection legs 52 and 54 with respect to the remaining portions of the preform 46. The preform 46 is bent along bend lines D and E to form an armature leg portion 62 of the armature assembly 40, as shown in FIG. 4. In a preferred embodiment, the central connection portion 48 includes a generally flat cover portion 64 that is attached to one or more other portions 65 of the central connection portion 48 to complete the armature assembly 40, as shown in FIG. 4. Preferably, the cover portion 64 is welded at a weld F. The cover portion 64 provides a large surface area that overlaps and interacts with the magnetic keeper region 56 to minimize the magnetic reluctance between the first and second leg portions 42 and 44. As with the first embodiment, a raised portion (not shown) can be provided on the cover portion 64 of the central connection portion 48 to act as a standoff between the cover portion 64 and the other portions 65 and the magnetic keeper region 56 of the central connection portion 48.

FIG. 6 illustrates an alternate embodiment two-piece armature assembly 70. In this embodiment, the armature assembly 70 includes a first leg portion 72 and a second leg portion 74. FIG. 7 generically depicts a preform 82 used to form the leg portions 72 and 74 of the armature assembly 70. Each of the leg portions 72 and 74 include a connection segment 75 having two connection flaps or tabs 76 and 78 that accommodate attachment of the leg portions 72 and 74 to each other. As can be seen in FIG. 7, a width of the connection segment 75 (which comprises connection flaps or tabs 76 and 78) is greater than a width of the remaining part of the leg portions 72 and 74. When the leg portions 72 and 74 are attached, a connection portion 79 is formed, as shown in FIG. 6. In a preferred embodiment, the leg portions 72 and 74 are connected via a snap fit. The connection flaps 76 and 78 are bent along bend lines G and H and can be punched to form either holes or dimples to facilitate connection with a second set of connection tabs. One pair of connection tabs 76 and 78 can be provided with holes and the other pair can be provided with dimples or other raised portions (not shown) that snap fit within the holes at a connection point 80, as shown in FIG. 6. With this snap fit of the dimples within the holes, one pair of the connection flaps 76 and 78 is pivotably fastened to the other pair at the connection point 80. Thus, the leg portions 72 and 74 can pivot with respect to each other about the connection point 80 and the stiffness of the armature is reduced. Since this embodiment has no inherent centering as in the previously described embodiments, a spring (not shown) can be provided between the two leg portions 72 and 74 to facilitate deflection of the leg portions 72 and 74 with respect to each other. The connection tabs 76 and 78 of one of the leg portions 72 and 74 will be spaced farther apart from each other to allow the connection tabs 76 and 78 of the other of the leg portions 72 and 74 to fit therebetween, as shown in FIG. 6. As can be seen in FIG. 6, one pair of flaps 76 and 78 overlaps with the other pair flaps 76 and 78, providing a surface area in which magnetic flux may pass between the leg portions 72 and 74. This surface area minimizes the magnetic reluctance between the leg portions 72 and 74.

FIG. 8 illustrates a one-piece armature 100 of the invention. The armature 100 is generally U-shaped and comprises a first leg portion 102 and a second leg portion 104 that are offset by a connection portion 106 disposed generally perpendicularly therebetween. The first and second leg portions 102 and 104 are generally flat and are disposed such that they are generally parallel to each other.

The first and second leg portions 102 and 104 and the connection portion 106 are integrally formed from a blank 108, as shown in FIG. 9. The blank 108 is made of a metallic material having good magnetic permeability that can be fabricated and formed through conventional metal fabrication and forming techniques that are well known in the art. The connection portion 106 is wider than the first and second leg portions 102 and 104, as shown in FIG. 9, but has a material thickness that is less than the first and second leg portions 102 and 104, as shown in FIG. 10. The connection portion 106 also includes angled portions 110 integrally formed between the connection portion 106 and the first and second leg portions 102 and 104. The angled portions 110 help to guide the magnetic flux from the wide connection portion 106 to the narrower leg portions 102 and 104. The angled portions 110 also help reduce the material stresses that would normally be concentrated at corners 112, during and after fabrication, if those corners 112 were positioned along bends 114 of the armature 100, as shown in FIG. 8. Additionally, the connecting portion 106 includes tapered portions 116 that reduce material stresses along the bends 114 of the armature 100, as shown in FIG. 10. The tapered portions 116 reduce the material stresses normally associated with sharp corner bends in metal fabrication.

The reduced material thickness of the connection portion 106 reduces the stiffness of the connection portion 106 while the greater width of the connecting portion 106 compensates for the increased magnetic flux density that would be associated with the decreased cross-sectional area of the connection portion 106 due to the reduced material thickness. Thus, the additional cross-sectional area associated with the wider connection portion 106 minimizes the magnetic flux density of the connection portion 106, which allows the magnetically permeable material of the armature 100 to be able to perform at higher receiver drive levels.

In a preferred embodiment, the connection portion 106 is half as thick and twice as wide as the first and second leg portions 102 and 104. This configuration keeps the cross-sectional area constant throughout the armature 100, thereby preserving the armature's ability to carry magnetic flux. Furthermore, the increased width of the connection portion 106 in this configuration does not increase the stiffness of the connection portion 106, since material stiffness is a function of the cube of the material thickness while only proportional to the width of the material.

The reduced stiffness of the connection portion 106, combined with its increased width, allows maximum magnetic flux to pass through the connection portion 106, as well as the first and second leg portions 102 and 104, while allowing maximum deflection between the first and second leg portions 102 and 104 for maximum output sound pressure of a receiver incorporating the armature 100.

Figure 11:
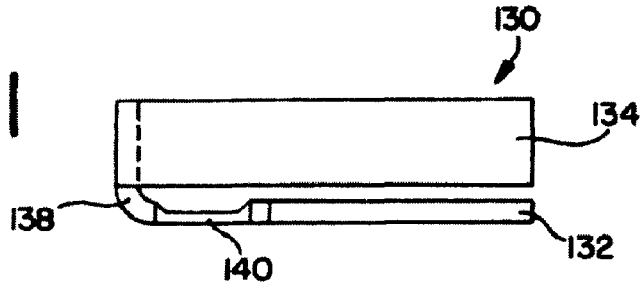
FIG. 11 is an elevational side view of a one-piece E-shaped armature according to the invention.
Figure 12:
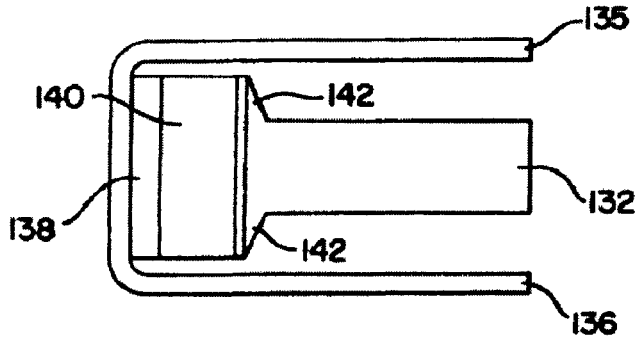
FIG. 12 is a top plan view of the E-shaped armature shown in FIG. 11.

FIG. 11 shows an alternate embodiment in the form of an E-shaped armature 130. The armature 130 includes a generally flat first leg portion 132 and a generally flat second leg portion 134. The second leg portion 134 has two legs 135 and 136 disposed generally transverse to the first leg portion 132, as shown in FIG. 12. The first leg portion 132 is disposed between the two legs 135 and 136 as shown in FIG. 12 and below the two legs 135 and 136 as shown in FIG. 11. A connection portion 138 is in communication with the first and second leg portions 132 and 134, as shown in FIGS. 11 and 12. The connection portion 138 includes a portion 140 having a material thickness that is less than the other portions of the armature 130. The reduced material thickness is best shown in FIG. 11. As shown in FIG. 12, the connection portion 138 includes angled portions 142 integrally formed between the portion 140 and the first leg portion 132, which is narrower than the portion 140. The angled portions 142 help to guide the magnetic flux from the portion 140 of the connection portion 138 to the narrower first leg portion 132.

Figure 13:
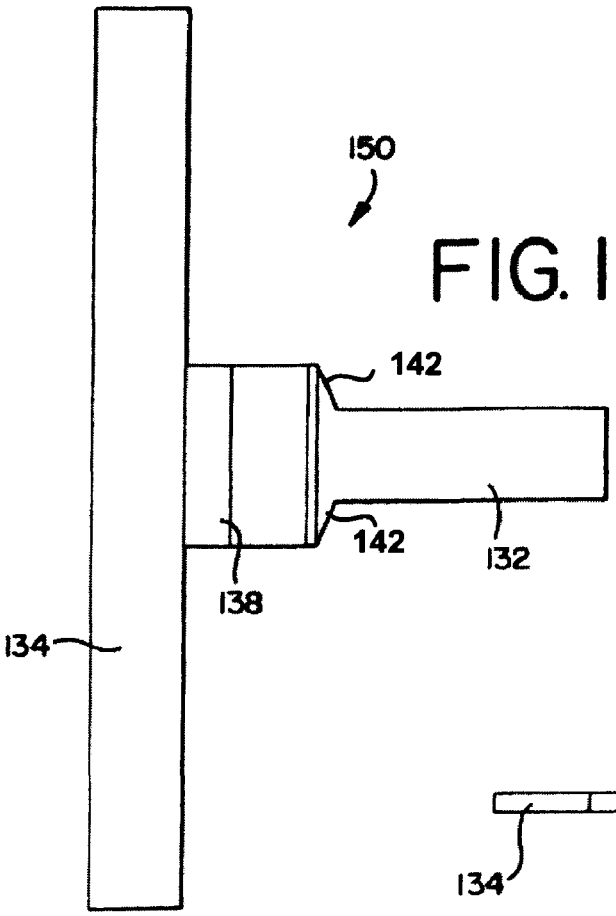
FIG. 13 is a top plan view of a blank used to form the one-piece E-shaped armature shown in FIG. 11.
Figure 14:
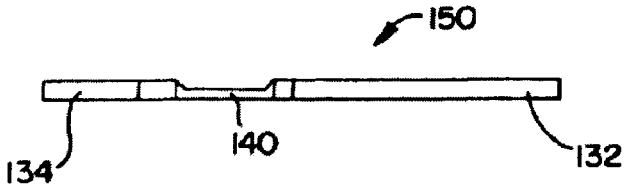
FIG. 14 is an elevational side view of the blank shown in FIG. 13.

The E-shaped armature 130 is formed from a blank 150, as shown in FIG. 13 and FIG. 14. The blank 150 is made of a metallic material having good magnetic permeability that can be fabricated and formed through conventional metal fabrication and forming techniques that are well known in the art.

The reduced material thickness of the portion 140 reduces its stiffness. This allows for an increased deflection of the first leg portion 132 with respect to the legs 135 and 136 of the second leg portion 134. The greater width of the connection portion 138 compensates for the increased magnetic flux density that would normally be associated with the decreased cross-sectional area of the portion 140 of the connection portion 138 due to the reduced material thickness without an increase in width. Thus, the additional cross-sectional area associated with the greater width minimizes the magnetic flux density associated with portion 140, which allows the magnetically permeable material of the armature 130 to be able to perform at higher receiver drive levels.

While the specific embodiments have been illustrated and described, numerous modifications may come to mind without significantly departing from the spirit of the invention, and the scope of protection is only limited by the scope of the accompanying claims.

What is claimed is:

1. An armature for a receiver comprising:

a first generally-flat armature leg portion having a first thickness, a first length, and a first width, the first length extending from a free end of the first armature leg portion to a fixed end of the first armature leg portion, the first thickness being orthogonal to the first length and orthogonal to the first width, the free end being free to move with respect to the fixed end;

a second generally flat armature leg portion having a second thickness and a second width, the second armature leg portion connected to the first armature leg portion in a generally parallel orientation to each other; and a connection portion integrally formed with the first and second armature leg portions, the connection portion having an extending portion that extends from the second armature leg portion, the extending portion having a third width, a third length, and a third thickness, the third width being disposed in parallel relation to the first width, the extending portion coupling to the fixed end of the first leg portion, the third thickness being orthogonal to the third length and the third width, and wherein the third thickness of the extending portion of the connection portion is less than the first thickness of the first armature leg portion and is less than the second thickness of the second armature leg portion;

wherein the connection portion reduces the stiffness of the armature and minimizes magnetic reluctance of the connection between the first and second armature leg portions.

2. The armature of claim 1, wherein the connection portion includes an angled portion integrally formed between the extending portion of the connection portion and the first leg portion, the angled portion guides the magnetic flux from the reduced material thickness portion to the first and second leg portions.

3. The armature of claim 2, further including two bends each adjacent to one of the first and second armature leg portions to form a generally U-shaped configuration with the connection portion.

4. The armature of claim 3, wherein the first and second armature leg portions are of generally equal length.

5. An armature for a receiver comprising:

a first generally-flat armature leg portion having a first length, a first thickness and a first width, the first length extending from a free end of the first armature leg portion to a fixed end of the first armature leg portion, the first thickness being orthogonal to the first length and the first width, the free end being free to move with respect to the fixed end;

a second generally flat armature leg portion having a second thickness and a second width, the second armature leg portion connected to the first armature leg portion; and a connection portion integrally formed with the first and second armature leg portions, the connection portion having an extending portion that extends outwardly from the second armature leg portion and couples to the fixed end of the first armature leg portion, the extending portion of the connection portion having a third length, a third width, and a third thickness, the third width being disposed in parallel relation to the first width, the third width greater than the first width of the first armature leg portion, and the third thickness being less than the first thickness of the first armature leg portion and being less than the second thickness of the second armature leg portion, the connection portion connected to the second armature leg portion to define two legs of the second armature leg portion in a transverse orientation to the first armature leg portion to form a substantially E shape armature;

wherein the connection portion reduces the stiffness of the armature and minimizes magnetic reluctance of the connection between the first and second armature leg portions.

6. The armature of claim 5, wherein the connection portion includes an angled portion integrally formed between the extending portion of the connection portion and the first leg portion, the angled portion guides the magnetic flux from the reduced material thickness portion to the first leg portion.

7. The armature of claim 6, further including three bends, one of the bends disposed adjacent to the second armature leg portion and the portion of reduced thickness of the connection portion, and two of the bends disposed within the second armature leg portion to form the two legs of the second armature leg portion.

8. The armature of claim 7, wherein the second armature leg portion has a generally U-shaped configuration.

9. An armature for a receiver comprising:

a first generally-flat armature leg portion having a thickness and a width;

a second generally flat armature leg portion having a thickness and a width, the second armature leg portion connected to the first armature leg portion in a generally parallel orientation to each other;

a connection portion integrally formed with the first and second armature leg portions, the connection portion having a width greater than the width of the first and second armature leg portions individually and at least a portion having a thickness less than the thickness of the first and second armature leg portions individually;

wherein the connection portion reduces the stiffness of the armature and minimizes magnetic reluctance of the connection between the first and second armature leg portions;

wherein the connection portion includes an angled portion integrally formed between the reduced material thickness portion of the connection portion and the first leg portion, the angled portion guides the magnetic flux from the reduced material thickness portion to the first and second leg portions.

10. The armature of claim 9, further including two bends each adjacent to one of the first and second armature leg portions to form a generally U-shaped configuration with the connection portion.

11. The armature of claim 10, wherein the first and second armature leg portions are of generally equal length.

12. An armature for a receiver comprising:

a first generally-flat armature leg portion having a thickness and a width;

a second generally flat armature leg portion having a thickness and a width, the second armature leg portion connected to the first armature leg portion; and a connection portion integrally formed with the first and second armature leg portions, the connection portion having a width greater than the width of the first and second armature leg portions individually and at least a portion having a thickness less than the thickness of the first and second armature leg portions individually, the connection portion connected to the second armature leg portion to define two legs of the second armature leg portion in a transverse orientation to the first armature leg portion to form a substantially E shape armature;

wherein the connection portion reduces the stiffness of the armature and minimizes magnetic reluctance of the connection between the first and second armature leg portions;

wherein the connection portion includes an angled portion integrally formed between the reduced material thickness portion of the connection portion and the first leg portion, the angled portion guides the magnetic flux from the reduced material thickness portion to the first leg portion.

13. The armature of claim 12, further including three bends, one of the bends disposed adjacent to the second armature leg portion and the portion of reduced thickness of the connection portion, and two of the bends disposed within the second armature leg portion to form the two legs of the second armature leg portion.

14. The armature of claim 13, wherein the second armature leg portion has a generally U-shaped configuration.

* * * * *

UNITED STATES PATENT AND TRADEMARK OFFICE

CERTIFICATE OF CORRECTION

PATENT NO. : 8,027,492 B2
APPLICATION NO. : 12/237731
DATED : September 27, 2011
INVENTOR(S) : Thomas Edward Miller It is certified that error appears in the above-identified patent and that said Letters Patent is hereby corrected as shown below:

ON THE TITLE PAGE:
In the section entitled "ABSTRACT" item (57); line 11 after "and the connection portion includes" delete "a least" and insert --at least-- therefor.

Signed and Sealed this
Sixth Day of December, 2011

David J. Kappos

David J. Kappos
*Director of the United States Patent and Trademark Office*